US005143517A

United States Patent [19]

Vermont

[11] Patent Number: 5,143,517

[45] Date of Patent: Sep. 1, 1992

[54] TURBOFAN WITH DYNAMIC VIBRATION DAMPING

[75] Inventor: Gérard R. E. R. Vermont, Coubert, France

[73] Assignee: Societe Nationale D'Etude et de Construction de Moteurs D'Aviation"S.N.E.M.C.A.", Paris, France

[21] Appl. No.: 742,010

[22] Filed: Aug. 8, 1991

[30] Foreign Application Priority Data

Aug. 8, 1990 [FR] France ..... 90 10107

[51] Int. Cl.[5] ..... F01D 5/26

[52] U.S. Cl. ..... 416/190; 416/193 A; 416/500

[58] Field of Search ..... 416/145, 190, 193 A, 416/500

[56] References Cited

U.S. PATENT DOCUMENTS

| | | | |
|---|---|---|---|
| 3,666,376 | 5/1972 | Damlis . | |
| 4,101,245 | 7/1978 | Hess et al. | 416/193 A |
| 4,182,598 | 1/1980 | Nelson | 416/500 |
| 4,723,889 | 2/1988 | Charreron et al. | 416/193 A |

FOREIGN PATENT DOCUMENTS

| | | | |
|---|---|---|---|
| 1263677 | 5/1961 | France . | |
| 0095702 | 4/1990 | Japan | 416/500 |
| 2112466 | 7/1983 | United Kingdom . | |

OTHER PUBLICATIONS

Soviet Union Abstract, I. A. Chernyaev, SU-A-1 127 979, Dec. 7, 1984.

*Primary Examiner*—Edward K. Look
*Assistant Examiner*—Christopher M. Verdier
*Attorney, Agent, or Firm*—Oblon, Spivak, McClelland, Maier & Neustadt

[57] ABSTRACT

A fan for a turboshaft engine is disclosed comprising a rotatable disc having an array of blades secured at evenly spaced intervals around its periphery, each pair of successive blades and the disc defining a space which is delimited by the stem and a platform of a first of the two blades, the stem and a platform of the second of the two blades, and the periphery of the disc between the two blades. In order to reduce vibration during operation of the fan, each of the spaces houses a flyweight and a pair of rigid rockers disposed between the flyweight and the stems and platforms of the first and second blades delimiting the space such that, under the action of centrifugal force generated by rotation of the disc, the flyweight acts on the first and second blades through the rockers, the two rockers mutually engaging each other while a first of the rockers bears on the stem and the platform of the first blade at separate positions, the second of the two rockers bears on the stem and the platform of the second blade at separate positions, and the flyweight bears on both the first and the second rockers.

9 Claims, 3 Drawing Sheets

TURBOFAN WITH DYNAMIC VIBRATION DAMPING

BACKGROUND OF THE INVENTION

1. Field of the Invention

The invention relates to a fan or blower for a turboshaft engine, such as a turbofan, and is particularly concerned with the reduction or suppression of the vibrations to which the fan blades are subjected.

2. Summary of the Prior Art

Various arrangements have already been proposed for suppressing such vibrations. For example, FR-A-1 263 677 discloses a fan assembly comprising a disc having an axis of rotation and a periphery defining a plurality of teeth spaced evenly apart around said disc and a plurality of recesses of dovetail-shaped cross-section disposed between said teeth, a plurality of blades secured to the periphery of said disc, each of said blades comprising a root having a dovetail shape corresponding to that of said recesses, said root being received in a respective one of said recesses, a stem extending radially outwards from said root, a profiled portion defining the blade proper disposed radially outwards from said stem, and two platforms extending transversely from said stem, one on each side thereof, at the junction between said stem and said profiled portion of the blade, said disc and said blades defining a plurality of spaces, each of said spaces being delimited by the stem and one of said platforms of a first of said blades, the stem and one of said platforms of a second of said blades adjacent said first blade, and the peripheral surface of said tooth disposed between the roots of said first and second blades, and a plurality of flyweights disposed one in each of said spaces such that, under the action of the centrifugal force generated when the disc rotates, the flyweights act on the platforms and/or on the stems of the blades.

It is found, however, that this known solution is, for the most part, generally insufficiently effective as a result of a direct, non-scaled down effect of the flyweights.

SUMMARY OF THE INVENTION

It is an object of the invention to increase the effectiveness of this known general arrangement by scaling down the reaction forces, with respect both to size and their areas of application.

To this end, according to the invention, a fan as hereinbefore described is further provided with a plurality of rigid rockers disposed two in each of said spaces so that said two rockers are interposed between said flyweight in said space and the stems and platforms of said first and second blades delimiting said space such that, under the action of centrifugal force generated by rotation of said disc, said flyweight acts on said first and second blades through said rockers, said two rockers mutually engaging each other while a first of said rockers bears on the stem and the platform of said first blade at separate positions, the second of said two rockers bears on the stem and the platform of said second blade at separate positions, and said flyweight bears on both said first and said second rockers.

Preferably the surface of each of the two rockers which is engaged by the flyweight is profiled as a cam whereby the distance between the flyweight and the position of mutual contact between the two rockers varies with the rocking of the rockers.

Preferably each of said spaces includes spring means engaging the flyweight and each of the two rockers so as to hold these elements together while permitting slight relative displacement thereof.

In a preferred arrangement this spring means comprises an open ring spring clip having two ends which act resiliently on faces of the two rockers opposite those which mutually engage each other, the spring clip surrounding an oblong part of the flyweight and being partly received in a groove formed in the oblong part.

Preferably each flyweight has a transversely extending end face which acts on an axial stop which is rigid with the disc. The axial stop may be formed by the head of a bolt which is fixed to the disc.

Preferably each flyweight and the two rockers associated therewith in the respective space are disposed in the said space without being fixed either to the disc or to the blades delimiting the space.

The principal advantage of the arrangement in accordance with the invention lies in reducing separately the vibrations to which the stems and the platforms of the blades are subjected.

In addition, designing the rockers as cams reinforces the vibratory energy dissipation force, and thus also increases the overall effectiveness of the fight against vibrations.

Other features and advantages of the invention will become apparent from the following description of a preferred embodiment, given by way of example, with reference to the accompanying drawings.

DESCRIPTION OF THE PREFERRED EMBODIMENT

Figure 1:
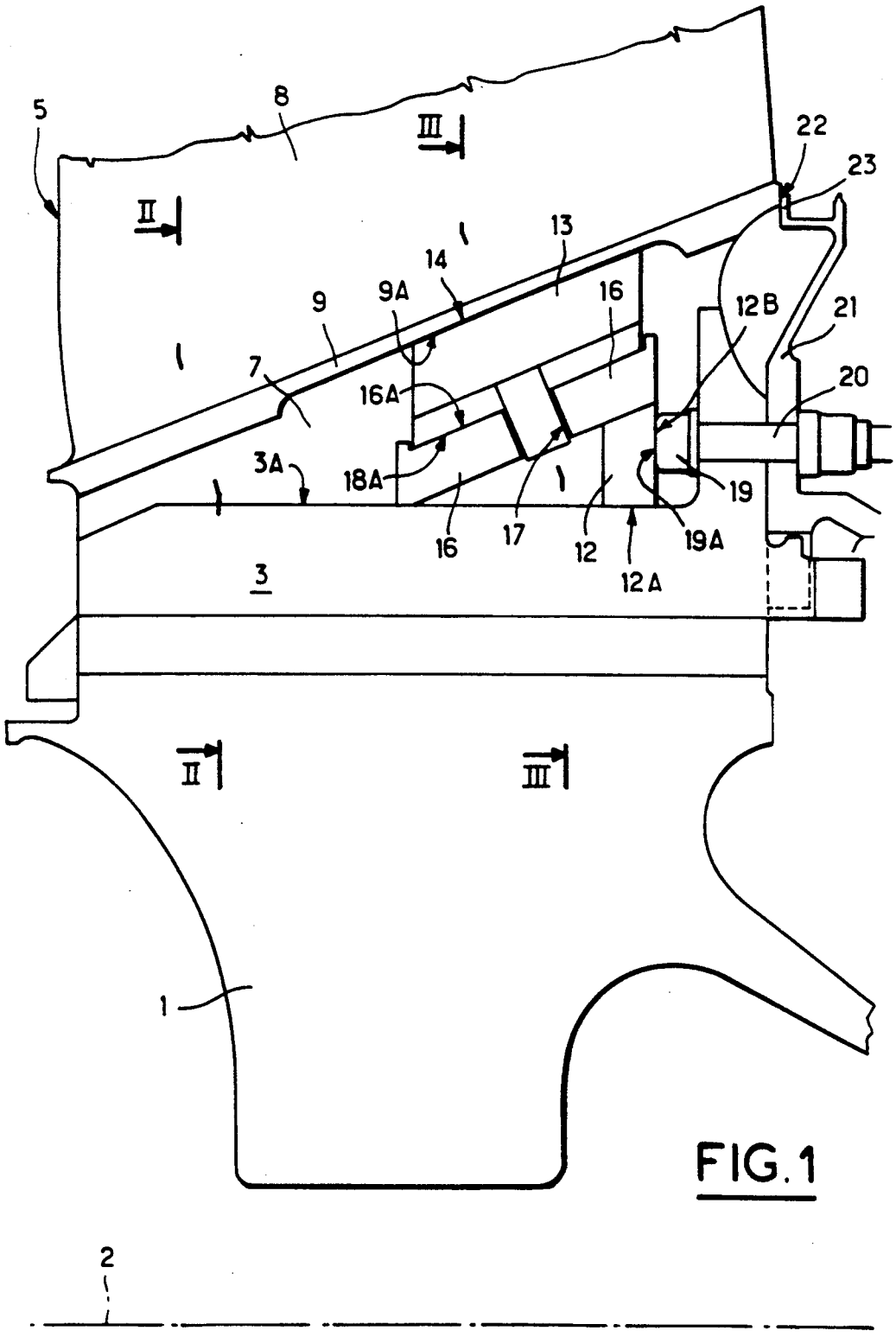
FIG. 1 is a substantially radial section, taken along line I—I in FIG. 3, through part of a preferred embodiment of a turbofan in accordance with the invention.
Figure 2:
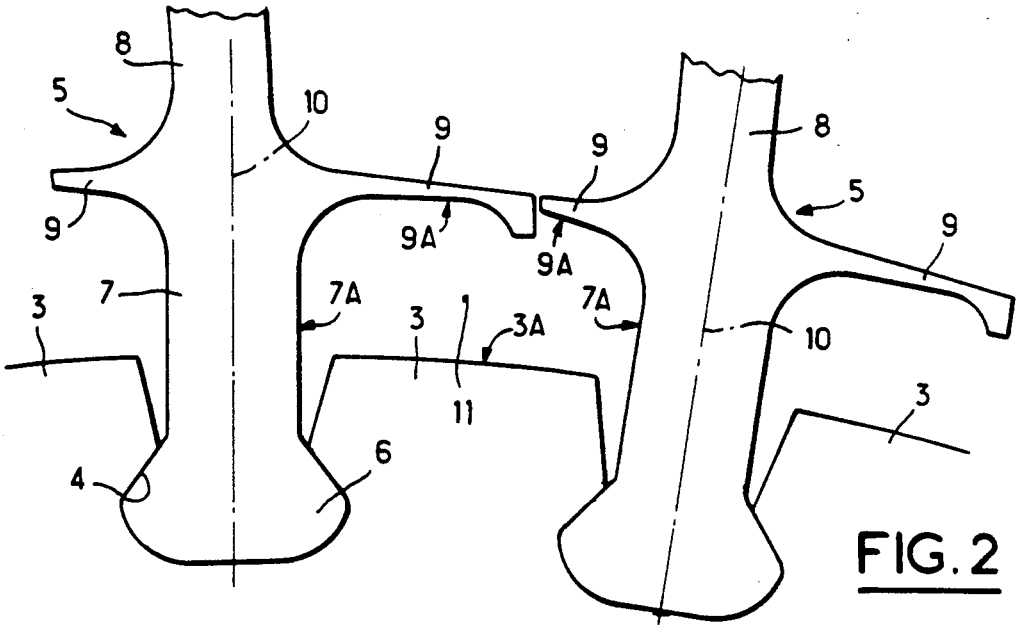
FIGS. 2 and 3 are partial transverse sections taken along lines II—II and III—III respectively in FIG. 1.
Figure 3:
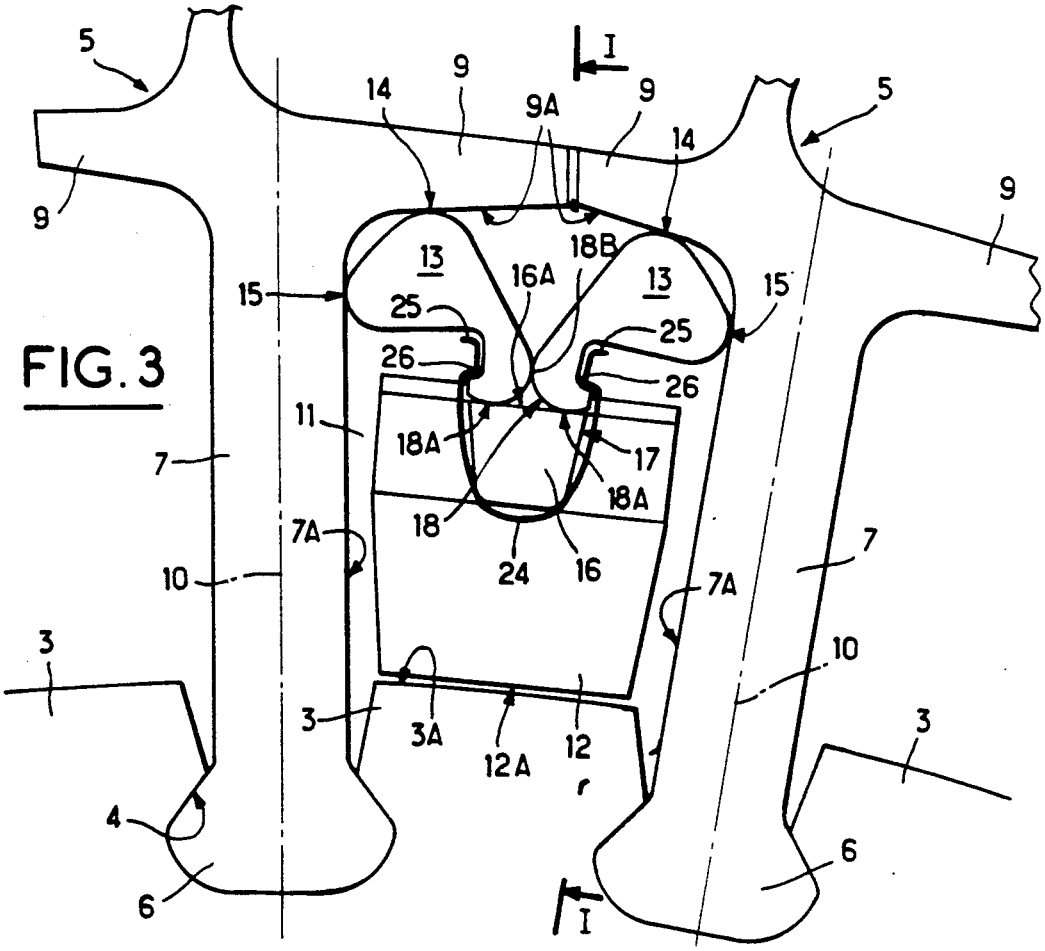

The drawings show a turbofan disc 1 which is mounted to rotate about an axis 2, and the periphery of which is formed with teeth 3 spaced equi-angularly apart around the periphery and defining dovetail-shaped recesses 4 between them.

An array of blades 5 are mounted on the disc 1 at equi-angular intervals around its periphery, each blade 5 comprising a root 6 having a dovetail-shape which corresponds to that of each recess 4, a stem 7 which extends from the root 6 and leads into the active profiled portion 8 of the blade, and two platforms 9 which extend laterally on opposite sides of the stem 7, substantially perpendicularly to the overall axis 10 of the blade, and which constitute the junction between the stem 7 and the active portion 8 of the blade.

Each blade 5 is mounted on the disc 1 by fitting its root 6 into a recess 4, the overall axis 10 of the blade extending substantially radially relative to the axis of rotation 2 of the disc 1, and the platforms 9 of the blade extending in the circumferential direction substantially parallel to the outer surfaces 3A of the teeth 3 between which the recess 4 is located. The ends of the facing platforms 9 of each two successive blades lie adjacent each other, and the faces 9A of these platforms 9 facing inwards towards the axis of rotation 2, together with the facing side faces 7A of the stems 7 of the two blades and the surface 3A of the tooth 3 between the blades, jointly define a space 11.

Each space 11 houses a flyweight 12 which either rests with its radially inner face 12A on the surface 3A of the tooth 3 or, under the action of centrifugal force, is slightly detached from the said surface 3A. The flyweight 12 has an oblong outer part 16 which, in this embodiment, is prismatic with a trapezoidal section. This oblong part 16 has an outer face 16A and is provided with a groove 17.

The space 11 also houses two rockers 13 of generally triangular section between the flyweight 12 and the platforms 9 defining the outer limit of the space. Two vertices of each rocker 13 form contact areas 14 and 15 respectively engaging the inner face 9A of the platform 9 and the side face 7A of the stem 7 of a respective one of the two blades defining the space 11. The third vertex of each rocker 13 is formed as a cam surface 18 having a contact area 18A which engages the outer face 16A of the oblong part of the flyweight 12, and a contact area 18B which engages the cam contact area 18B of the other rocker 13.

Figure 4:
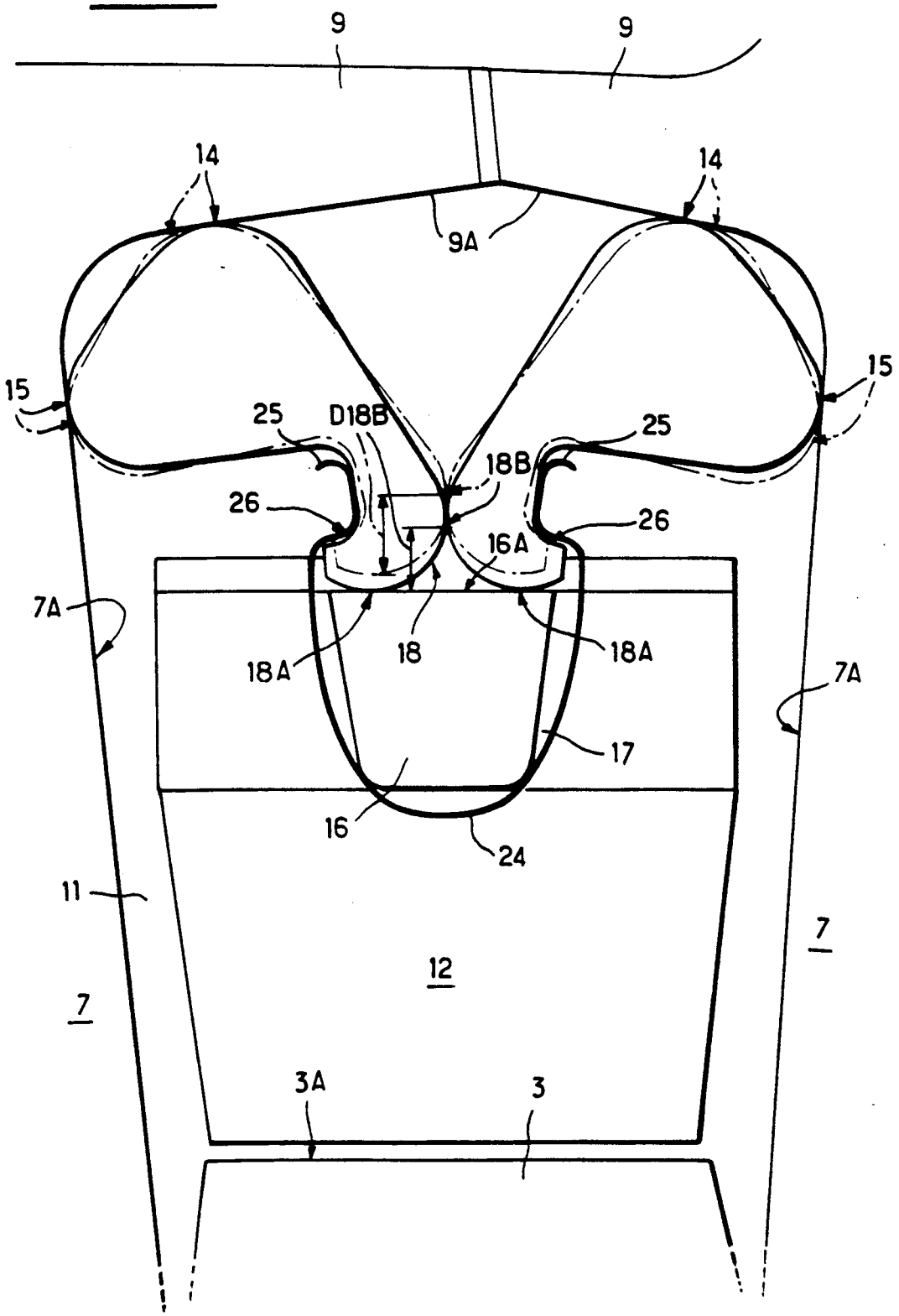
FIG. 4 is a view, on a larger scale, of part of FIG. 3, showing a detail of the arrangement in accordance with the invention.

As may be seen in FIG. 4, the arrangement is such that the distance D18B of the contact area 18B from the outer face 16A of the oblong part 16 of the flyweight is variable as a function of the positions of the two rockers relative to each other and to the stems 7 and platforms 9 of the blades, this being dependent on the shape of the cams 18. Thus, the more the area 18B is displaced from the axis of rotation 2, the greater is the distance D 18B, the greater is the scaling down of the contact reactions in the areas 18B, and the more substantial and effective are the contact reactions in the areas 14 and 15.

The flyweight 12 has a transverse end face 12B lying perpendicular to the axis of rotation 2 and axially abutting against the face 19A of the head 19 of a bolt 20 securing a flange 21 to the disc 1. The outer periphery of the flange 21 has a channel-shaped cross-section of which one of the branches 23 acts on one of the axial ends 22 of each blade 5.

It will also be observed that a spring clip 24 of open ring form and having two ends 25 surrounds the oblong part 16 of the flyweight 12, being held in position relative thereto by being partly received in the groove 17. The two ends 25 form hooks and are received in rebates 26 formed one in each of the rockers 13 near its third vertex. These rebates 26 are arranged in the faces of the rockers which are substantially opposite the mutual contact areas 18B. The spring 24 thus constitutes means for holding together the assembly consisting of the two rockers 13 and the flyweight 12 while permitting very slight relative displacements of these elements.

It should be noted in this connection that the positions of the rockers shown in full and broken lines in FIG. 4 have been deliberately exaggerated for purposes of illustration, and in fact the displacements are much less than as shown.

The embodiment shown permits the dissipation of vibratory energy through slight friction which occurs between the faces which are in contact: i.e. faces 16A and 18A; faces 9A and 14; faces 7A and 15; and faces 18B and 18B; and also between the ends 22 of the blades and the branch 23 of the flange 21.

The following points should be noted:

the bearing areas of each rocker 13 and, through the rockers, of the flyweight 12 on the blades 5 are separate from each other: the area 14 bearing on the face 9A of the platform 9 being entirely separate from the area 15 bearing on the face 7A of the stem 7, which ensures a satisfactory distribution of the reactions on the blades, particularly on the platforms and on the stems;

as already observed, the values of these reactions are increased by the scaling down obtained by the cams 18;

the increase in the friction areas and the increase of the values of the reactions lead to the achievement of a good dissipation of the vibratory energy;

the assembly constituted by the flyweight 12,16 and the rockers 13 is fixed neither to the disc 1 nor to the blades 5, but is held in the space 11 in which it is housed as a result of the faces 12A and 12B of the flyweight acting on the outer face 3A of the tooth 3 and on the axial face 19A of the bolt 20 respectively, and of the rockers 13 acting on the blades 5 in the areas 14 and 15.

The invention is not limited to the embodiment shown but is intended to embrace all the modifications that may be made without departing from the spirit and scope thereof as defined by the following claims.

I claim:

1. A fan for a turboshaft engine comprising:

a disc having an axis of rotation and a periphery defining a plurality of teeth spaced evenly apart around said disc and a plurality of recesses of dovetail-shaped cross-section disposed between said teeth, a plurality of blades secured to the periphery of said disc, each of said blades comprising a root having a dovetail shape corresponding to that of said recesses, said root being received in a respective one of said recesses, a stem extending radially outwards from said root, a profiled portion defining the blade proper disposed radially outwards from said stem, and two platforms extending transversely from said stem, one on each side thereof, at the junction between said stem and said profiled portion of the blade, said disc and said blades defining a plurality of spaces, each of said spaces being delimited by the stem and one of said platforms of a first of said blades, the stem and one of said platforms of a second of said blades adjacent said first blade, and the peripheral surface of said tooth disposed between the roots of said first and second blades, a plurality of flyweights disposed one in each of said spaces, and a plurality of rigid rockers disposed two in each of said spaces so that said two rockers are interposed between said flyweight in said space and the stems and platforms of said first and second blades delimiting said space such that, under the action of centrifugal force generated by rotation of said disc, said flyweight acts on said first and second blades through said rockers, said two rockers mutually engaging each other while a first of said rockers bears on the stem and the platform of said first blade at separate positions, the second of said two rockers bears on the stem and the platform of said second blade at separate positions, and said flyweight bears on both said first and said second rockers.

2. A fan according to claim 1, wherein the surface of each of said two rockers which is engaged by said flyweight is profiled as a cam whereby the distance between said flyweight and the position of said mutual engagement between said two rockers varies as said rockers rock.

3. A fan according to claim 1, including spring means in each of said spaces engaging said flyweight and each of said two rockers so as to hold said flyweight and said rockers together while permitting slight relative displacements thereof.

4. A fan according to claim 3, wherein said spring means comprises an open ring spring clip having two ends which act resiliently on faces of said two rockers opposite those which mutually engage each other.

5. A fan according to claim 4, wherein said flyweight has an oblong part, and said spring clip surrounds said oblong part of said flyweight.

6. A fan according to claim 5, wherein said oblong part is provided with a groove, and said spring clip is partly received in said groove.

7. A fan according to claim 1, wherein each of said flyweights has a transversely extending end face, and a respective axial stop which is rigid with said disc is provided for engagement by said end face.

8. A fan according to claim 7, wherein said axial stop is formed by the head of a bolt which is fixed to said disc.

9. A fan according to claim 1, wherein each of said flyweights and said two rockers associated therewith in the respective space are disposed in said space without being secured either to said disc or to said blades delimiting said space.

* * * * *

UNITED STATES PATENT AND TRADEMARK OFFICE

CERTIFICATE OF CORRECTION

PATENT NO. : 5,143,517

DATED : September 1, 1992

INVENTOR(S) : Gerard R.E.R. VERMONT

It is certified that error appears in the above-indentified patent and that said Letters Patent is hereby corrected as shown below:

Column 2, line 53, change "dovetail-shape" to —dovetail shape—.

Signed and Sealed this

Twenty-fifth Day of January, 1994

*Attest:*

Bruce Lehman

BRUCE LEHMAN

*Attesting Officer*

*Commissioner of Patents and Trademarks*